US008448363B2

(12) United States Patent
Fargnoli et al.

(10) Patent No.: US 8,448,363 B2
(45) Date of Patent: May 28, 2013

(54) SYSTEM FOR EJECTING SHELLS FROM EITHER RIGHT OR LEFT SIDE OF A WEAPON

(76) Inventors: Thomas Angelo Fargnoli, Naples, NY (US); Miranda Allison Bernabei, Naples, NY (US); Ronald Herman Kohlstaedt, Naples, NY (US)

( * ) Notice: Subject to any disclaimer, the term of this patent is extended or adjusted under 35 U.S.C. 154(b) by 243 days.

(21) Appl. No.: 13/023,143

(22) Filed: Feb. 8, 2011
(Under 37 CFR 1.47)

(65) Prior Publication Data

US 2011/0232149 A1 Sep. 29, 2011

Related U.S. Application Data

(60) Provisional application No. 61/302,172, filed on Feb. 8, 2010.

(51) Int. Cl.
*F41A 3/00* (2006.01)

(52) U.S. Cl.
USPC ..... 42/16; 42/46

(58) Field of Classification Search
USPC ..... 42/16, 46, 106, 98; 89/33.4
See application file for complete search history.

(56) References Cited

U.S. PATENT DOCUMENTS 2,940,201 A * 6/1960 Reed ..... 42/16
3,619,926 A * 11/1971 Alday ..... 42/16
3,791,060 A * 2/1974 Weaver ..... 42/16
3,882,625 A * 5/1975 Tellie ..... 42/25
3,938,271 A * 2/1976 Hyytinen ..... 42/16
3,952,440 A * 4/1976 Tellie ..... 42/106
3,999,318 A * 12/1976 Tellie ..... 42/106
4,044,487 A * 8/1977 Hutton et al. ..... 42/16
4,562,659 A * 1/1986 Neta ..... 42/75.03
4,594,803 A * 6/1986 Muncy ..... 42/98
4,691,615 A * 9/1987 Brunton ..... 89/33.4
5,918,401 A * 7/1999 Rowlands ..... 42/16
6,785,994 B2 * 9/2004 Christiansen ..... 42/1.05
6,966,137 B2 * 11/2005 Gussalli Beretta ..... 42/46
7,395,626 B2 * 7/2008 Zedrosser ..... 42/25
7,596,900 B2 * 10/2009 Robinson et al. ..... 42/7
8,051,595 B2 * 11/2011 Hochstrate et al. ..... 42/75.01
8,393,103 B2 * 3/2013 Brown ..... 42/16
2004/0055198 A1 * 3/2004 Gussalli Beretta ..... 42/46
2012/0174451 A1 * 7/2012 Overstreet et al. ..... 42/16

* cited by examiner

*Primary Examiner* — Michelle Clement
(74) *Attorney, Agent, or Firm* — Woods Oviatt Gilman LLP

(57) ABSTRACT

A system allowing either right or left-side (ambidextrous) ejection of a shell from a weapon is provided. The system may comprise a bolt receiver having left and right-side ejection ports; a firing bolt assembly having left and right-side alignment slots and an extractor claw; and a relocatable ejection port cover assembly disposed alternatively in either the right or left-side ejection port to eject a shell from the opposite open ejection port. The ejection ports and the cover assembly may be formed having bilateral symmetry to facilitate relocation of the cover assembly from one side to the other. The cover assembly comprises a mounting flange, an ejection port plug disposed within either of the ejection ports, and a rail configured for being disposed within the alignment slots and including an extended portion and a contact face that engages the shell so that it is ejected from the open ejection port.

20 Claims, 3 Drawing Sheets

SYSTEM FOR EJECTING SHELLS FROM EITHER RIGHT OR LEFT SIDE OF A WEAPON

CROSS-REFERENCE TO RELATED APPLICATIONS

This application claims the benefit of U.S. Patent Application No. 61/302,172, filed Feb. 8, 2010. U.S. Patent Application No. 61/302,172 is hereby incorporated by reference in its entirety.

BACKGROUND OF THE INVENTION

The present invention relates to firearms; more particularly, to sidearms and shoulder-fired longarms that eject a spent cartridge shell from a side of the weapon after firing; and most particularly, to a system that allows a manufacturer or gun owner to select either the right-side or left-side (ambidextrous) ejection of shells from a given weapon.

Guns that eject a spent cartridge shell exclusively from one side of the weapon during a firing and reloading cycle are well known in the art of weapons. Typically, the shell is gripped by one or more extractor claws, elements of the bolt mechanism, during loading of a cartridge into the firing chamber. As the bolt is withdrawn after firing, the spent cartridge engages an ejector blade that causes the shell to be disengaged from the extractor claw(s) and propelled out of an ejector port defined in the bolt receiver.

Typically, a weapon is formed with the ejector port on the right side of the bolt receiver ("right" as used herein meaning the side of the weapon with respect to the shooter when the weapon is in firing position). For right-handed shooters, and especially for such shooters aiming the weapon with the right eye, this arrangement provides for convenient expulsion of shells in a direction away from the shooter's face and body. However, for left-handed shooters, and especially for such shooters aiming the weapon with the left eye, the opposite is true; spent shells are expelled undesirably toward the shooter's face and body. Therefore, a conventional right-side ported weapon is ill-suited to a left-handed shooter. One way to address this drawback is to manufacture left-side ported weapons having the internal ejection components reversed, but the market for such weapons is relatively small since the preponderance of the population is right-handed. The incentive for making left-side ported weapons is relatively low and thus manufacturing costs are proportionally higher. In addition, the owners of left-side ported weapons would likely face a chronic shortage of spare parts.

What is needed in the art is a system that allows a manufacturer or gun owner to select interchangeably either the right-side or left-side (ambidextrous) ejection of shells from a given weapon, preferably by the simple relocation of a minimal number of weapon components.

It is one aspect of the present invention to permit alternative configuration of the shell ejection mechanism of a given weapon as either right-side ejecting or left-side ejecting. The present invention fulfills this need as well as other needs.

BRIEF SUMMARY OF THE INVENTION

Briefly described, a system in accordance with the present invention comprises a bolt receiver having both left-side and right-side ejection ports defined in the weapon, a firing bolt assembly having both left-side and right-side alignment slots and a optional relocatable extractor claw, and a relocatable ejection port cover assembly that may be disposed alternatively in either the right-side or the left-side ejection port to allow shells to be ejected from the opposite port. The ejection ports and the relocatable ejection port cover assembly may be formed having bilateral symmetry to facilitate relocation of the cover from one ejection port to the other. The ejection port cover assembly comprises a mounting flange adapted to be selectively coupled to the bolt receiver. The ejection port cover assembly may also include an ejection port plug extending from a surface of the mounting flange, an alignment rail extending from the ejection port plug configured for being slidably received within either of the alignment slots in the firing bolt assembly, and an ejector extension formed in a distal end of the alignment rail that defines an ejector blade that is configured for engaging and ejecting a shell from the open ejection port.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1A:
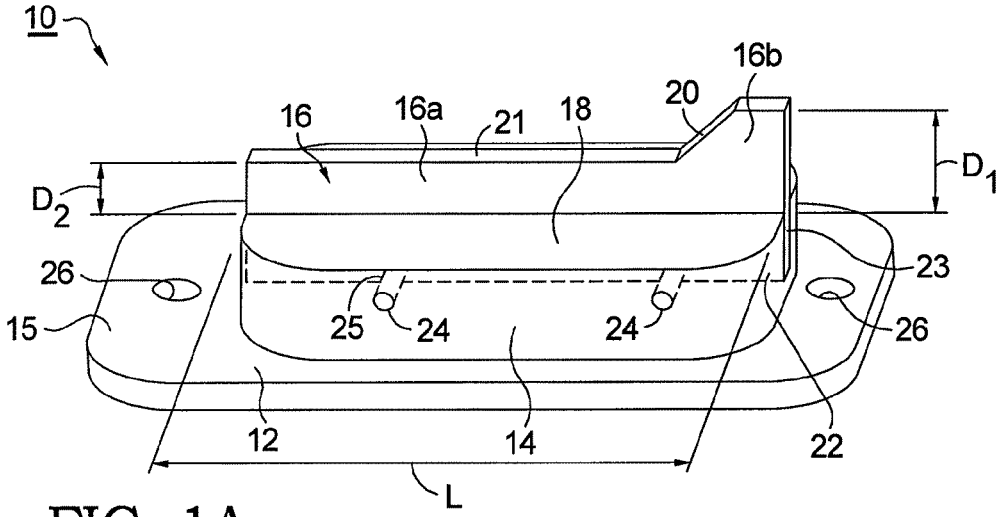
FIG. 1A is a perspective view of one embodiment of an ejection port cover assembly in accordance with the present invention.
Figure 1B:
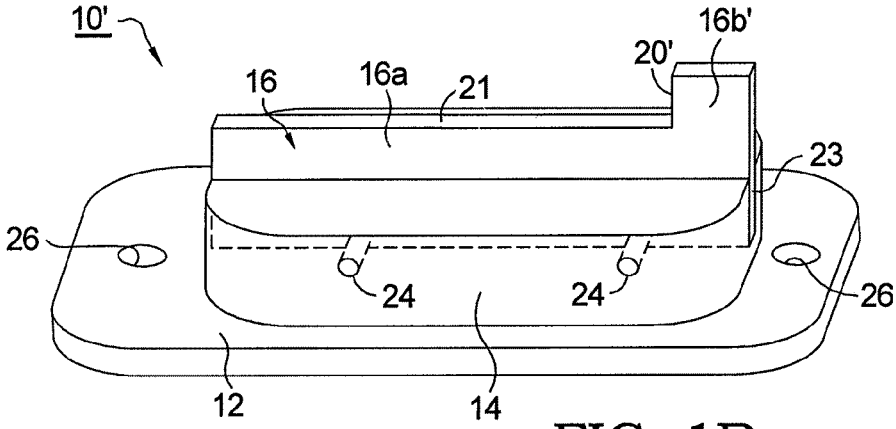
FIG. 1B is a perspective view of another embodiment of the ejection port cover assembly shown in FIG. 1A.

Referring to the drawings in more detail, and initially to FIG. 1A, an ejection port cover assembly is disclosed and is identified as reference numeral 10. Ejection port cover assembly 10 may include a mounting flange 12, and an ejection port plug 14 extending from an inner surface 15 of mounting flange 12. A rail 16 extends perpendicularly from a surface 18 of ejection port plug 14 and includes an alignment portion 16*a*, an extension portion 16*b*, and a contact face 20 disposed between alignment portion 16*a* and extension portion 16*b*. Extension portion 16*b* may extend outwardly from surface 18 of ejection port plug 14 a distance $D_1$, and alignment portion 16*a* may extend outwardly from surface 18 a distance $D_2$, wherein distance $D_1$ is greater than $D_2$. While contact face 20 and a top edge 21 of alignment portion 16*a* are shown in FIG. 1A as forming an obtuse angle relative to one another, it should be understood that another embodiment of ejection port cover assembly 10' may include a top edge 21 and contact face 20' of an extension portion 16*b*' that are disposed at a perpendicular angle relative to one another, as best seen in FIG. 1B. In both instances, contact face 20 will operate to eject a shell from an open ejection port in accordance with the present invention. Further, ejection port cover assembly 10 is formed in a size and shape such as to fit in either a right-side or left-side ejection port of a shell-ejecting weapon to assist in preventing the escape of blowback combustion gases during firing of the weapon and to assist in ejecting a shell from the open ejection port.

Mounting flange 12, ejection port plug 14, and rail 16 may be formed from sheet steel as by stamping or other metal forming methods. As best seen in FIG. 1A, a base portion 22 of rail 16 may be selectively positioned in a longitudinal slot 23 defined in ejection port plug 14. Base portion 22 of rail 16 may be secured within longitudinal slot 23 by one or more press-fit pins, screws, or other types of fasteners 24, that are fed through corresponding apertures 25 defined in ejection port plug 14. Rail 16 may extend the entire length L of ejection port plug 14. It should be understood that base portion 22 may have apertures defined therein that are configured for accepting such fasteners 24, or fasteners 24 may rest against a side surface of rail. Configuring rail 16 as a separate component relative to ejection port plug 14 gives a user or manufacturer of a weapon the ability to interchange different sized $D_1$ ejector extension portions 16*b* within longitudinal slot 23, which will in turn allow for caliber shells of various sizes to be ejected from the weapon. Mounting flange 12 may have one or more holes 26 defined therein to facilitate mounting to a receiver weapon, as will be described in more detail below.

Figure 1C:
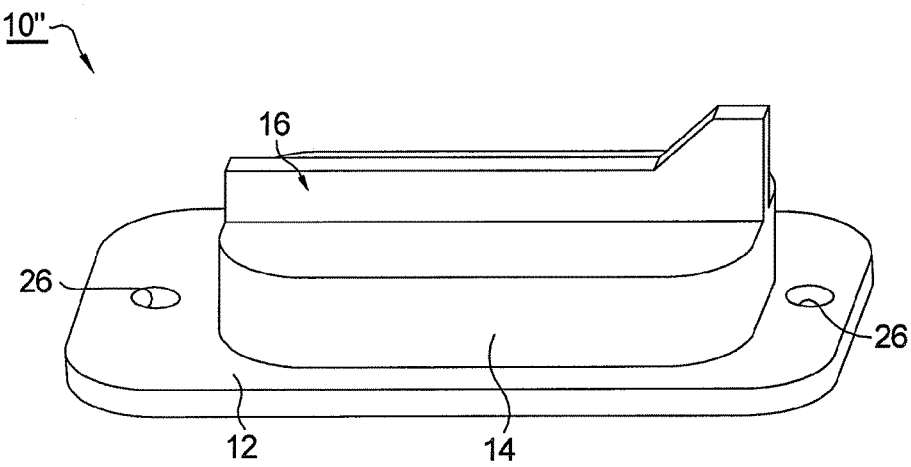
FIG. 1C is a perspective view of yet another embodiment of the ejection port cover assembly shown in FIG. 1A.

As best seen in FIG. 1C, another embodiment of ejection port cover assembly 10" may be formed as an integral monolithic unit as by machining from a block of material, by molding in an appropriate mold, or joined together by welding. In other words, mounting flange 12, ejection port plug 14 and rail 16 are integrally formed with one another in ejection port cover assembly 10". Suitable materials are various steel alloys well known in the art of gun fabrication or suitable polymers having the strength and durability to withstand the thermal and chemical conditions of a weapon breech.

Figure 2:
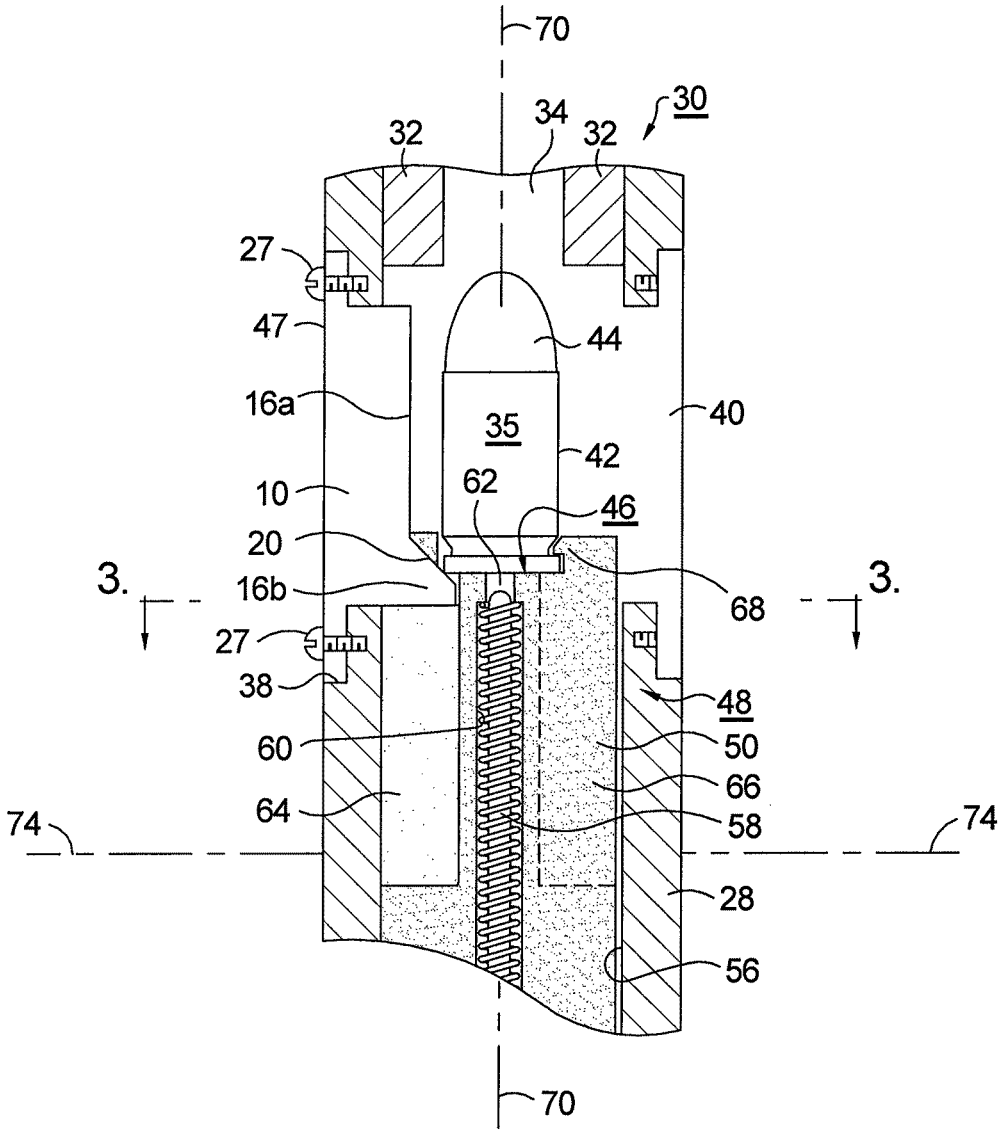
FIG. 2 is a cross-sectional plan view of an embodiment of a system in accordance with the present invention for right-side shell ejection.
Figure 3:
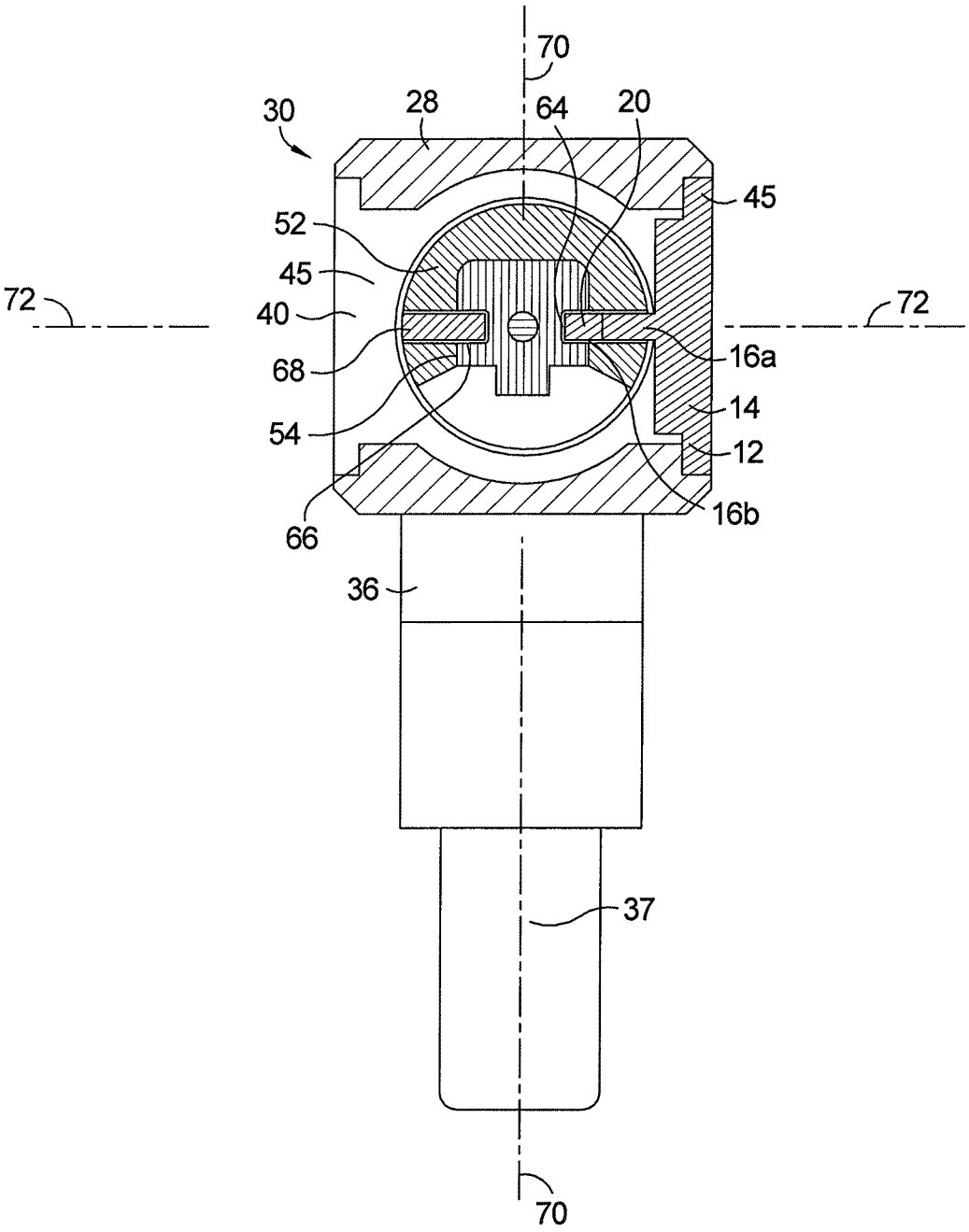
FIG. 3 is an elevational cross-sectional view of the embodiment shown in FIG. 2 taken along line 3-3 looking toward a shooter holding the weapon.

Referring now to FIGS. 2 and 3, ejection port cover assembly 10 may be mounted by one or more screws 27 to a bolt receiver 28 of a dual ejection-ported weapon 30. It is also within the scope of the present invention to use other types of fasteners to mount ejection port cover assembly 10 to weapon 30. Weapon 30 includes a barrel 32 having a firing chamber 34 for receiving a generic cartridge 35. Weapon 30 further comprises a lower receiver or magazine well 36 and a trigger guard 37. As shown in FIGS. 2 and 3, ejection port cover assembly 10 is disposed in the left-side ejection port 38, thereby leaving the right-side ejection port 40 open for ejection of a shell 42 from cartridge 35 after a bullet 44 is fired. In the example shown in FIGS. 2 and 3, right-side ejection port 40 is therefore the open ejection port. Bolt receiver 28 may have a recess 45 defined adjacent to both ejection ports 38, 40 configured for receiving mounting flange 12 so that an outer surface 47 of mounting flange 12 may be flush or in general conformance with the sides of receiver portion 28. The shape of recesses 45 are formed to conform closely with the outer periphery of mounting flange 12 to assist with positioning the ejection port cover assembly 10 correctly in the weapon.

Cartridge 35 is shown captured at an end 46 of a firing bolt assembly 48. Firing bolt assembly 48 comprises a firing bolt 50 including a bolt front face 52 and a recessed bolt face 54. Cartridge 35 is seated on recessed bolt face 54. Firing bolt 50 is slidably disposed in a first bore 56 defined in bolt receiver 28. A firing pin 58 is slidably disposed in a second bore 60 defined in firing bolt 54, and may be arranged as shown for center-fire cartridges or for rim-fire cartridges. In particular, firing pin 58 is extendible through an opening 62 defined in recessed bolt face 54 to cause discharge of cartridge 35 when properly positioned in firing chamber 34.

Firing bolt 50 is further provided with left and right alignment slots 64, 66 that are each configured for allowing rail 16 to be slidably disposed therein when ejection port cover assembly 10 is mounted in either of ejection ports 38 (as shown) or 40, respectively, to guide firing bolt 50. Furthermore, an extractor claw 68 for gripping the base of shell 42 may be disposed in whichever one of alignment slots 64, 66 is not in use with rail 16. Extractor claw 68 may also be used as a pivot point for the shell 42 as shell 42 is engaged with contact face 20 when shell 42 is being ejected from the open ejection port. However, it should be understood that extractor claw 68 need not be included in firing bolt assembly 48 in order for shell 42 to be ejected from the open ejection port using ejection port cover assembly 10.

In one embodiment, both firing bolt 50 and bolt receiver 28 are bilaterally symmetrical about a longitudinal vertical plane 70; alignment slots 64, 66 are bilaterally symmetrical about a longitudinal horizontal plane 72; and right-side and left side ejection ports 38, 40 are bilaterally symmetrical about a transverse vertical plane 74 and preferably also about said longitudinal horizontal plane 72. Further, the corners of mounting flange 12 and recesses 45 may be radiused. This arrangement increases simplicity in manufacture and in conversion from right-side to left-side ejection and vice versa.

In operation, for example when the ejection port cover assembly 10 is mounted in left-side ejection port 38 as shown in FIGS. 2 and 3, cartridge 35 is placed in firing chamber 34 so that extractor claw 68 engages shell 42. The firing bolt 50 is moved into barrel 32 prior to the firing of bullet 44. Firing pin 58 is then propelled through opening 62 to ignite the charge in cartridge 35 thereby propelling bullet 44 out of cartridge 35 and through barrel 32. After bullet 44 is removed from shell 42, the empty shell 42 remains coupled to recessed bolt face 54 of firing bolt 50 due to its engagement with extractor claw 68. As firing bolt 50 moves back toward the position shown in FIG. 2, shell 42 engages contact face 20 and begins to rotate about a pivot point established by extractor claw 68. Shell 42 continues to move in the direction of the open right-side ejection port 40 until shell 42 is ejected from weapon 30. The operation of ejecting shell 42 from left-side ejection port 38 would be similar to that which was described above, except ejection port cover assembly 10 would be repositioned in right-side ejection port 40. Moreover, it should be understood that ejection port cover assembly 10 would effectively eject shell 42 even if extractor claw 68 is not present in firing bolt assembly 48.

One method of changing over weapon 30 from right-side ejection (as seen in FIGS. 2 and 3) to left-side ejection, when extractor claw 68 is formed in firing bolt 50, comprises the steps of: removing firing bolt assembly 48 from first bore 56; relocating extractor claw 68 from alignment slot 66 to alignment slot 64; removing screws 27 from ejection port cover assembly 10 and bolt receiver 28 of weapon 30, and relocating ejection port cover assembly 10 from left-side ejection port 38 to right-side ejection port 40; securing ejection port cover assembly 10 with screws 27 to right-side ejection port 40; and reinstalling firing bolt assembly 48 in first bore 56.

Although the present invention has been described in considerable detail with reference to certain preferred versions thereof, other versions are possible. Therefore, the spirit and scope of the appended claims should not be limited to the description of the preferred versions contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A relocatable ejection port cover assembly disposable alternatively in either of a right-side ejection port or a left-side ejection port defined in a weapon for ejecting a shell from the opposite open ejection port, said ejection port cover assembly comprising:

a mounting flange adapted to be selectively coupled to the weapon, said mounting flange including an inner surface;

an ejection port plug extending from said inner surface of said mounting flange and configured for being positioned within either the right-side ejection port or the left-side ejection port, said ejection port plug including a surface; and a rail extending outwardly from said surface of said ejection port plug, said rail including an alignment portion, an extension portion, and a contact face disposed between said alignment portion and said extension portion, said alignment portion extending outwardly a first distance from said surface of said ejection port plug, said extension portion extending outwardly a second distance from said surface of said ejection port plug, said second distance being greater than said first distance, wherein said contact face is configured for engaging a shell disposed within the weapon so that the shell is ejected from the opposite open ejection port.

2. A relocatable ejection port cover assembly in accordance with claim 1, wherein said ejection port plug has a slot defined therein, and wherein said rail is removably positioned within said slot.

3. A relocatable ejection port cover assembly in accordance with claim 2, further comprising at least one fastener, wherein said at least one fastener is used to removably couple said rail within said slot of said ejection port plug.

4. A relocatable ejection port cover assembly in accordance with claim 1, wherein said mounting flange, said ejection port plug, and said rail are integrally formed with one another.

5. A relocatable ejection port cover assembly in accordance with claim 1, wherein said alignment portion of said rail includes a top edge, and wherein said contact face is disposed at an obtuse angle relative to said top edge.

6. A relocatable ejection port cover assembly in accordance with claim 1, wherein said alignment portion of said rail includes a top edge, and wherein said contact face is disposed at a perpendicular angle relative to said top edge.

7. An ambidextrous shell ejection system for a weapon comprising:

a bolt receiver having a left-side ejector port and a right-side ejector port defined therein;

a firing bolt assembly slidably disposed within said bolt receiver, said firing bolt assembly having left-side and right-side longitudinal alignment slots defined therein; and a relocatable ejection port cover assembly disposable alternatively in either of said right-side ejection port or said left-side ejection port, said ejection port cover assembly including:

a mounting flange adapted to be selectively coupled to said bolt receiver, said mounting flange including an inner surface;

an ejection port plug extending from said inner surface of said mounting flange and configured for being positioned within either said right-side ejection port or said left-side ejection port, said ejection port plug including a surface; and a rail extending outwardly from said surface of said ejection port plug, said rail including an alignment portion, an extension portion, and a contact face disposed between said alignment portion and said extension portion, said alignment portion extending outwardly a first distance from said surface of said ejection port plug, said extension portion extending outwardly a second distance from said surface of said ejection port plug, said second distance being greater than said first distance, wherein said contact face is configured for engaging a shell disposed within said bolt receiving portion so that the shell is ejected from said ejection port that said ejection port plug is not positioned within.

8. An ambidextrous shell ejection system in accordance with claim 7 wherein said firing bolt assembly includes at least one extractor claw.

9. An ambidextrous shell ejection system in accordance with claim 8 wherein said at least one extractor claw is disposed in one of said left-side or right-side longitudinal alignment slots.

10. An ambidextrous shell ejection system in accordance with claim 7 wherein the weapon is selected from the group consisting of sidearm and shoulder-fired longarm.

11. An ambidextrous shell ejection system in accordance with claim 7 wherein at least a portion of said ejection port cover assembly is formed of a material selected from the group consisting of metal alloy and polymer.

12. An ambidextrous shell ejection system in accordance with claim 7 wherein said firing bolt assembly and said bolt receiver are bilaterally symmetrical about a longitudinal vertical plane.

13. An ambidextrous shell ejection system in accordance with claim 7 wherein said left-side and right-side longitudinal alignment slots and said ejection port cover assembly are bilaterally symmetrical about a longitudinal horizontal plane.

14. An ambidextrous shell ejection system in accordance with claim 7 wherein said right-side ejection port and said left side ejection port are bilaterally symmetrical about a transverse vertical plane and a longitudinal horizontal plane.

15. An ambidextrous shell ejection system in accordance with claim 7, wherein said ejection port plug has a slot defined therein, and wherein said rail is removably positioned within said slot.

16. A relocatable ejection port cover assembly in accordance with claim 15, further comprising at least one fastener, wherein said at least one fastener is used to removably couple said rail within said slot of said ejection port plug.

17. A relocatable ejection port cover assembly in accordance with claim 7, wherein said mounting flange, said ejection port plug, and said rail are integrally formed with one another.

18. A relocatable ejection port cover assembly in accordance with claim 7, wherein said alignment portion of said rail includes a top edge, and wherein said contact face is disposed at an obtuse angle relative to said top edge.

19. A relocatable ejection port cover assembly in accordance with claim 7, wherein said alignment portion of said rail includes a top edge, and wherein said contact face is disposed at a perpendicular angle relative to said top edge.

20. A firearm weapon comprising:

a bolt receiver having a left-side ejection port and a right-side ejector port defined therein;

a firing bolt assembly slidably disposed within said bolt receiver, said firing bolt assembly having left-side and right-side longitudinal alignment slots defined therein;

a barrel attached to said bolt receiver, said barrel having a firing chamber defined therein for receiving a cartridge from said firing bolt assembly, said cartridge including a shell and a bullet;

a relocatable ejection port cover assembly disposable alternatively in either of said right-side ejection port or said left-side ejection port, said ejection port cover assembly including:

a mounting flange adapted to be selectively coupled to said bolt receiver, said mounting flange including an inner surface;

an ejection port plug extending from said inner surface of said mounting flange and configured for being positioned within either said right-side ejection port or said left-side ejection port, said ejection port plug including a surface; and a rail extending outwardly from said surface of said ejection port plug, said rail including an alignment portion, an extension portion, and a contact face disposed between said alignment portion and said extension portion, said alignment portion extending outwardly a first distance from said surface of said ejection port plug, said extension portion extending outwardly a second distance from said surface of said ejection port plug, said second distance being greater than said first distance, wherein said contact face is configured for engaging said shell disposed within said bolt receiving portion so that the shell is ejected from said ejection port that said ejection port plug is not positioned within.

* * * * *